United States Patent [19]

Kojima et al.

[11] Patent Number: 4,539,225

[45] Date of Patent: Sep. 3, 1985

[54] METHOD FOR THE PRODUCTION OF A HEAT-SENSITIVE RECORD MATERIAL

[75] Inventors: Kazuo Kojima; Hitoshi Yamahira, both of Osaka; Yoshitaka Oeda, Kamimachi, all of Japan

[73] Assignee: Kanzaki Paper Manufacturing Co., Ltd., Tokyo, Japan

[21] Appl. No.: 581,123

[22] Filed: Feb. 17, 1984

[30] Foreign Application Priority Data

Feb. 23, 1983 [JP] Japan ..... 58-29977

[51] Int. Cl.[3] ..... B41M 5/18

[52] U.S. Cl. ..... 427/150; 346/200; 427/151; 427/361; 427/363; 427/365

[58] Field of Search ..... 346/200, 226, 201; 427/150, 151, 152, 355, 361, 363–366

[56] References Cited

U.S. PATENT DOCUMENTS 4,455,346 6/1984 Igarashi et al. ..... 346/200

FOREIGN PATENT DOCUMENTS 2104234 3/1983 United Kingdom ..... 346/200

*Primary Examiner*—Bruce H. Hess

*Attorney, Agent, or Firm*—Morgan, Finnegan, Pine, Foley & Lee

[57] ABSTRACT

In order to produce a heat-sensitive record material having high speed recordability without fogging a heat-sensitive record material having a heat-sensitive record layer coated thereon is passed through a nip between a metal roll and an elastic roll of 42° to 69° Shore-D hardness defined by ASTM Standard, D-2240 at a nip pressure enough to obtain a Bekk smoothness of 150 seconds or above on the record layer surface.

5 Claims, No Drawings

METHOD FOR THE PRODUCTION OF A HEAT-SENSITIVE RECORD MATERIAL

BACKGROUND OF THE INVENTION

This invention relates to a method for the production of a heat-sensitive record material and more particularly to an improved surface treatment of a heat-sensitive record material.

The heat-sensitive recording system is generally based on the principle of heating a thermal recording head (hereinafter referred to simply as "head") in response to an input signal, whereby a colorless chromogenic material and a color acceptor on the record material sheet contacted with said head are melted and contacted with each other to provide a color image. It has a recording speed matching with the amount of information in a band carried by a telephone circuit and is of the primary color developing system not requiring the developing or fixing process, and because of little wear of the head, it is being rapidly applied to information equipment such as printers and facsimile machines.

Particularly, with the recent enormously increasing amount of information, development has been made from the so-called low speed machines such as facsimile machines in which the record time required for one page of paper size A4 is about 6 minutes to the high speed machines such as facsimile machines of about 1 minute in the same definition and the super high speed machines having much higher recording speeds, and with such increase in the processing speed of recording apparatuses, record sheets used herewith are being improved in various respects. Among them the smoothing treatment of the record layer surface has been studied and investigated as one of the most important factors in that it increases the degree of contact between the head and the record layer surface to facilitate heat transfer. If, however, a high speed record material sheet having a record layer with a composition designed to increase recording sensitivity is treated by any one of conventional supercalenders and other various smoothing devices incorporated to coaters, the record layer surface, though highly smoothed, is suffered from incidental fogging and the degree of color brightness of the recording layer is greatly lowered. Thus, the present situation is that it is inevitable to perform either a light degree of surface treatment at the sacrifice of smoothness or a smoothing treatment at the sacrifice of the degree of brightness of the record layer surface.

In view of such situation, we have made an intensive study in order to develop a method of properly smoothing the record layer surface without causing fogging. Particularly, after an extensive investigation of the construction and material of the rolls defining the pressing nip of the smoothing apparatus, the operating conditions of the smoothing apparatus and the composition of the recording layer, we have found that the use of a specific elastic roll having a softness which is undreamed of in the case of the conventional pressing and smoothing apparatus makes it possible to effect a smoothing treatment of the record layer surface which is desirable to imparting high speed recordability to the record layer surface without involving unevenness of color development, which finding has led to the achievement of the present invention.

The principal object of the invention is to provide an improved method of the surface treatment of a heat-sensitive record material in which a heat-sensitive record material having excellent high speed recordability can be efficiently produced without causing fogging.

The other objects and advantages of the invention will become apparent from the following detailed description.

SUMMARY OF THE INVENTION

The method of the surface treatment of a heat-sensitive record material according to the invention comprises:

preparing a heat-sensitive record material comprising a base sheet having a heat-sensitive record layer coated thereon, and passing said record material through a nip between a metal roll and an elastic roll of from 42° to 69° Shore-D hardness defined by ASTM Standard, D-2240, with said coated layer being in contact with said metal roll, at a nip pressure enough to obtain a Bekk smoothness of 150 seconds or above on the surface of said record layer.

Thus, the invention is particularly characterized in the use of an elastic roll formed of an elastic body whose Shore-D hardness defined by ASTM Standard, D-2240 has a particular value of 42° to 69°, as described above. The elastic roll used is very soft as compared with the elastic roll whose Shore-D hardness is about 75° to 85° used in conventional supercalenders.

An elastic roll softer than 42° would require an excessively high line pressure to obtain sufficient surface smoothness, which pressure, in operation, would drastically shorten the life of the elastic body. Reversely, an elastic roll harder than 69° would make it difficult to effectively prevent occurrence of fogging. Thus, an elastic roll having a hardness of 42° to 69°, preferably, 50° to 69°, most preferably, 60° to 69° is ued.

DETAILED DESCRIPTION OF THE INVENTION

As for the elastic bodies forming elastic rolls according to the invention, there is no particular limitation so long as the hardness falls within the aforesaid particular limits, and mention may be made of, e.g., natural fiber, styrene rubber, nitrile rubber, chloroprene rubber, chlorosulphonated ethylene rubber, butyl rubber, polysulfide rubber, silicone rubber, fluororubber, urethane rubber, various plastic resins, cotton, paper, wool, Tetlon (polyester), Nylon (polyamide), and mixtures thereof. Among them, urethane rubber, a mixture of paper and wool (woolen paper), a mixture of wool and Nylon, a mixture of wool and Tetlon, a mixture of paper, wool and Tetlon, and a mixture of paper, wool and Nylon are preferably used. Particularly, elastic rolls using urethane rubber and woolen paper are more preferably used since they are easy to handle, have a long life, and are capable of efficiently developing the desired effects of the present invention.

The hardness of the elastic roll may be controlled at will by selection of the kind and composition of the material therefor and the various conditions for the production steps of the elastic roll.

In the method according to the invention, there is no limitation about the metal roll cooperating with the aforesaid particular elastic roll to define the pressing nip. Chilled rolls, alloy chilled rolls, steel rolls, and metal rolls with a hard chromium plated surface which are used in smoothing apparatuses such as conventional supercalenders and gloss calenders may be suitably selectively employed. The configuration of the pressing apparatus, and the number of nips are to be suitably adjusted as in the conventional smoothing apparatus, but it is necessary that they should be adjusted so that the Bekk smoothness of the record layer surface is 150 seconds or above in order to provide sufficiently high speed recordability. The upper limit of the Bekk smoothness available would be 3000 seconds and the most preferable range thereof is 200 to 2000 seconds.

Thus, in the method according to the present invention, a heat-sensitive record material is passed through such particular pressing nip with the record layer surface contacted with the metal roll surface and is thereby subjected to a smoothing treatment so that the Bekk smoothness of said record layer surface is 150 seconds or above, the pressing conditions to be used being suitably adjusted according to various treating conditions such as the hardness of the elastic roll, the type of the record material sheet, running speed, the number of nips, and temperature. It is desirable generally, but not always, that the nip line-pressure be adjusted within the limits of 30–300 kg/cm. If the nip line-pressure is below 30 kg/cm, the record sheet produced under operating conditions for preventing fogging even with a relatively hard elastic roll will have an uneven thickness so that it is difficult to obtain satisfactory high speed recordability. Further, in the case of a nip line-pressure exceeding 300 kg/cm, even if a soft elastic roll is used it becomes difficult to prevent occurrence of fogging and the generation of heat by the elastic roll itself considerably increases, making a stabilized operation impossible.

In addition, even under stabilized operating conditions, elastic rolls used in the method according to the invention, which are much softer than ordinary rolls, as described above, tend to generate heat, and this tendency is noticeable particularly in elastic rolls using urethane rubbr. The generation of heat makes the physical properties of the elastic body unstable and in extreme cases the elastic body itself is melted and damaged by the heat stored therein. Therefore, it is preferable to pass a coolant through the roll for cooling, and such measures as cooling from the outside and changes in roll diameter and in the wall thickness of the elastic body will be taken according to the need.

According to the invention, even in the case of a heat-sensitive recording sheet having a record layer made of a composition having greatly increased recording sensitivity suitable for high speed recording, surface treatment of the record layer surface can be effected without causing fogging. Thus, heat-sensitive recording sheets having improved high speed recordability can be efficiently produced. The reason why such excellent results are obtained is not always clear but out belief, though we never wish to limit the proposed mechanism thereto, is that because of the employment of an extremely soft elastic roll which has never been proposed to utilize in the conventional pressing and treating apparatus, the particular pressing nip used in the present invention has a width as large as about 5 to 25 mm and the distribution of the local nip pressure throughout in the direction of the width entirely differs from that in the conventional supercalender or the like, thereby effectively preventing occurrence of fogging and developing a smoothing effect suitable for the record layer surface.

Thus, according to the invention, a heat-sensitive record sheet having a record layer made of a composition having generally increased recording sensitivity as described above can be treated. For example, a heat-sensitive record sheet containing a binder whose amount is 35% by weight or less based on the total solid content in order to increase recording sensitivity, which would produce a great deal of fogging if treated by the conventional method can be subjected to a desired smoothing treatment without fogging.

While there is no particular limitation on heat-sensitive record materials which are to be treated for smoothness by the method according to the present invention, a recording sheet is generally used which has a substrate coated with a heat-sensitive coating composition containing a substantially colorless basic chromogenic material, an acceptor and a binder is generally used.

Among the substantially colorless chromogenic materials, there are included, by way of examples, triarylmethane derivatives such as 3,3-bis(p-dimethylaminophenyl)-6-dimethylaminophthalide, 3,3-bis(p-dimethylaminophenyl)phthalide, and 3-(p-dimethylaminophenyl)-3-(1,2-dimethylindole-3-yl)phthalide; diphenylmethane derivatives such as 4,4'-bis-dimethylaminobenzhydryl benzyl ether and N-halophenylleucoauramine; thiazine derivatives such as benzoylleucomethylene blue and p-nitrobenzoylleucomethylene blue; spiro derivatives such as 3-methylspirodinaphthopyran, 3-ethyl-spiro-dinaphthopyran and 3-propylspiro-dibenzopyran; lactam derivatives such as rhodamine-B-anilinolactam and rhodamine(p-nitroanilino)lactam; and fluoran derivatives such as 3-dimethylamino-7-methoxyfluoran, 3-diethylamino-6-methoxyfluoran, 3-(N-ethyl-p-toluidino)-7-methylfluoran, 3-diethylamino-7-N-acetyl-N-methylaminofluotan, 3-diethylamino-7-N-methylaminofluoran, 3-diethylamino-7-dibenzylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carboxymethoxyphenylamino)fluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-(N-methyl-N-n-amyl-)amino-6-methyl-7-anilinofluoran, 3-(N-ethyl-N-n-amyl)amino-6-methyl-7-anilinofluoran, 3-(N-ethyl-N-iso-amyl)amino-6-methyl-7-anilinofluoran, 3-(N-methyl-N-n-hexyl)amino-6-methyl-7-anilinofluoran, 3-(N-ethyl-N-n-hexyl)amino-6-methyl-7-anilinofluoran and 3-(N-ethyl-N-$\beta$-ethylhexyl)amino-6-methyl-7-anilinofluoran.

The chromogenic materials may be used solely or in combination.

Among the acceptors, there are included by way of examples, phenolic compounds such as 4-tert-octylphenol, 4,4'-sec-butylidenediphenol, 4-phenylphenol, 4,4'-isopropylidenediphenol, 4,4'-cyclohexylidenediphenol, 4,4'-dihydroxydiphenylsulfide, 4,4'-thiobis(6-tert-butyl-3-methylphenol), 4,4'-dihydroxydiphenylsulfone, hydroquinone monobenzyl ether, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenetyl 4-hydroxybenzoate, p-chlorobenzyl 4-hydroxybenzoate, p-methoxybenzyl 4-hydroxybenzoate, novolak phenol resin and other phenol polymer; aromatic carboxylic acids such as benzoic acid, p-tert-butylbenzoic acid, terephthalic acid, salicylic acid, 3-isopropylsalicylic acid, 3-benzylsalicylic acid, 3,5-di-tert-butylsalicylic acid, 3-phenyl-5-(α,α-dimethylbenzyl)salicylic acid and 3,5-di-α-methylbenzylsalicylic acid; and salts of the above mentioned phenolic compounds and aromatic carboxylic acids with polyvalent metal such as magnesium, aluminum, calcium, titamium, zinc, manganese, tin and nickel.

The acceptors may be used solely or in combination.

There is no special limitation about the composition ration of the basic chromogenic material and the acceptor. Usually, the amount of the acceptor is within the range of 100 to 700 parts by weight, preferably 150 to 400 parts by weight, per 100 part by weight of a chromogenic material.

The coating composition comprising the chromogenic material and the acceptor may be prepared by dispersing both or each of chromogenic material and acceptor in water with an agitator or pulverizer such as ball mill, attritor, sand mill and the like.

The coating composition generally comprises a binder such as starches, hydroxyethylcellulose, methylcellulose, carboxymethylcellulose, gelatin, casein, gum arabic, polyvinyl alcohol, salts of styrene-maleic anhydride copolymers and styrene-butadiene copolymer emulsion. The binder may be used in an amount of 2 to 35% by weight, preferably 5 to 25% by weight with respect to the total solid amount.

In the coating composition various additives may also be added. Among the additives, for example, there are included dispersing agents such as sodium dioctylsulfosuccinate, sodium dodecylbenzenesulfonate, sodium salt of laurylsulfate and metal salts of fatty acid; deforming agent; fluorescent dyes; coloring dyes; sensitizers such as amides, e.g., stearic acid amide, stearic acid methylenebisamide, oleic amide, palmitic acid amide, sperm oleic amide, coconut fatty acid amide and methylol amide, benzophenone derivatives, e.g., 2-hydroxy-4-methoxybenzophenone and 2-hydroxy-4-benzyloxybenzophenone, triazole derivatives, e.g., 2-(2'-hydroxy-3',5'-di-tert-butylphenyl)-benzotriazole and 2-(2'-hydroxy-5'-tert-octylphenyl)benzotriazole, hindered phenols, e.g., 2,2'-methylenebis(4-ethyl-6-tert-butylphenol), 2,2'-methylenebis(4-methyl-6-tert-butylphenol), 4,4'-butylidenebis(6-tert-butyl-3-methylphenol) and 1,1,3-tris(2-methyl-4-hydroxy-5-tert-butylphenyl)butane, dimethyltelephthalate, terphenyl, dibenzyl isophthalate, benzyl p-benzyloxybenzoate, di-p-tryl-carbonate, α-naphthyl benzyl ether,β-naphthyl benzyl ether and phenyl 1-hydroxy-2-naphtoate.

Further, there may be added inorganic pigments such as kaolin, clay, talc, calcium carbonate, calcined kaolin, calcined clay, titanium oxide, diatomaceous earth, finely divided silicic anhydride and activated clay in order to decrease smuges on recording head and increase the whiteness of the heat-sensitive recording layer; and dispersion or emulsion of waxes such as stearic acid, polyethylene, carnauba wax, paraffin wax, calcium stearate, zinc stearate and ester wax in order to prevent the heat-sensitive record material from being stuck in contact with recording head.

The recording layer may be produced by any of known techniques. For example, coating operation can be carried out utilizing any of known coater such as airknife coater, blade coater, bar coater, gravure coater and polylayer coater. Among them blade coater is preferably used to produce a recording layer superior in smoothness.

The amount of coating composition applied to form a recording layer, though not particularly limited, usually is 2 to 12 g/m$^2$, preferably 3 to 10 g/m$^2$.

The base sheet may be any of known types. The typical sheet materials would be paper, plastic film and synthetic paper, but paper is used most preferably. If required, the base sheet may be calendered before coating. This previous smoothing step before coating is effective to control various conditions for the further treatment after coating.

DETAILED DESCRIPTION OF THE PREFERRED EMBODIMENT

The following examples serve to illustrate the invention in more detail although the invention is not limited to the examples. Unless otherwise indicated, parts and % signify parts by weight and % by weight, respectively.

EXAMPLE 1

(1) Preparation of A liquid:

The following composition was passed through a sand mill.

| | |
|---|---|
| 3-(N—cyclohexyl-N—methylamino)-6-methyl-7-phenylaminofluoran | 10 parts |
| 5% aqueous solution of methylcellulose | 15 parts |
| water | 10 parts |

Pulverization was continued until an average particle size of 3 microns.

(2) Preparation of B liquid:

The following composition was passed through a sand mill.

| | |
|---|---|
| benzyl 4-hydroxy benzoate | 20 parts |
| 5% aqueous solution of methylcellulose | 30 parts |
| water | 20 parts |

Pulverization was continued until an average particle size of 3 microns.

(3) Making a heat-sensitive record material:

There were mixed with stirring 35 parts of A liquid, 70 parts of B liquid, 30 parts of finely divided particles of silicic anhydride, 115 parts of 20% aqueous solution of oxidized starch and 90 parts of water to prepare a coating composition.

The coating composition was coated on a non-calendered base sheet of 50 g/m$^2$, which had a Bekk smoothness of 50 seconds, in an amount of 7.5 g/m$^2$ on dry basis with an air knife coater and dried.

The coated sheet was treated by a supercalender comprising three metal rolls and two elastic rolls under the conditions of a nip line-pressure of 30 kg/cm, a nip width of 5 mm and a running speed of 120 m/min with cooling the inner side of the elastic rolls so as to maintain the surface temperature at below 60° C. to prepare a heat-sensitive record material. The above three metal rolls were chromium-plated metal rolls in which the top roll had a diameter of 450 mm, the middle roll had a diameter of 340 mm and the bottom roll had a diameter of 500 mm, and the above two elastic rolls were woolen paper rolls each of which had a diameter of 400 mm and a Shore-D hardness of 68°.

EXAMPLE 2

A heat-sensitive record material was prepared in the same manner as in Example 1 except that two woolen paper rolls having a Shore-D hardness of 63° were used as elastic rolls of supercalender and the calendering was carried out under the condition of a nip line-pressure of 100 kg/cm and a nip width of 9 mm.

EXAMPLE 3

A heat-sensitive record material was prepared in the same manner as in Example 2 except that two urethane rubber rolls having a Shore-D hardness of 63° were used as elastic rolls of the supercalender.

EXAMPLE 4

A heat-sensitive record material was prepared in the same manner as in Example 2 except that a calendered base sheet of 50 g/m$^2$ having a Bekk smoothness of 400 seconds was used.

EXAMPLE 5

A heat-sensitive record material was prepared in the same manner as in Example 4 except that the amount of 20% aqueous solution of oxidized starch comprised in the coating composition was 40 parts and the coating composition was coated on the base sheet with a blade coater.

EXAMPLE 6

A heat-sensitive record material was prepared in the same manner as in Example 1 except that two urethane rubber rolls having a Shore-D hardness of 45° were used as elastic rolls of the supercalender and the calendering was carried out under the conditions of a nip line-pressure of 250 kg/cm and a nip width of 20 mm.

EXAMPLE 7

A heat-sensitive record material was prepared in the same manner as in Example 1 except that two urethane rubber rolls having a Shore-D hardness of 55° was used as elastic rolls of the supercalender and the calendering was carried out under the conditions of a nip line-pressure of 200 kg/cm and a nip width of 15 mm.

EXAMPLE 8

(1) Preparation of A liquid:

| | |
|---|---|
| 3-(N—ethyl-p-tolyidino)-6-methyl-7-phenylaminofluoran | 100 parts |
| phenyl 1-hydroxy-2-naphtoate | 300 parts |
| 10% aqueous solution of polyvinyl alcohol | 10 parts |
| 5% aqueous solution of methylcellulose | 10 parts |

Water was added to the above composition to prepare a dispersion having a solid content of 30%. The dispersion was passed through a sand mill and pulverization was continued until an average particle size of 3 microns.

(2) Preparation of B liquid:

| | |
|---|---|
| 4,4'-isopropylidinediphenol | 200 parts |
| 10% aqueous solution of polyvinylalcohol | 20 parts |
| 5% aqueous solution of methylcellulose | 20 parts |

Water was added to the above composition to prepare a dispersion having a solid content of 30%. The dispersion was passed through a sand mill and pulverization was continued until an average particle size of 3 microns.

(3) Making a heat-sensitive record material:

There were mixed with stirring 130 parts of A liquid, 70 parts of B liquid, 50 parts of calcined kaolin, 100 parts of 20% aqueous solution of oxidized starch, 50 parts of 20% aqueous dispersion of zinc stearate and water to prepare a coating composition having a solid content of 25%.

A heat-sensitive record material was prepared with thus obtained coating composition in the same manner as in Example 1.

EXAMPLE 9

A heat-sensitive record material was prepared in the same manner as in Example 8 except that in the coating composition the amount of calcined kaolin was 100 parts and 200 parts of 10% aqueous solution of polyvinyl alcohol was added instead of 100 parts of 20% aqueous solution of oxidized starch.

Control 1

A heat-sensitive record material was prepared in the same manner as in Example 1 except that the calendering was carried out with use of two normal cotton rolls having a Shore-D hardness of 82° as elastic rolls of the supercalender under the condition of a nip line-pressure of 70 kg/cm and a nip width of 6 mm.

Control 2

A heat-sensitive record material was prepared in the same manner as in Example 1 except that the calendering was carried out with use of two urethane rubber rolls having a Shore-D hardness of 40° as elastic rolls of the supercalender under the conditions of a nip line-pressure of 250 kg/cm and a nip width of 25 mm.

Control 3

A heat-sensitive record material was prepared in the same manner as in Control 1 except that the coating composition obtained in Example 8 was used.

The properties of the heat-sensitive record materials obtained in each of the above Examples and Controls were examined. The results of examination is given with following Table 1.

TABLE 1

| | Supercalendering Treatment | | | | Properties of Heat-Sensitive Record Materials | | | | |
|---|---|---|---|---|---|---|---|---|---|
| | elastic rolls | | nip pressure | | *1 | | | | |
| | material | Shore-D hardness | line-pressure (kg/cm) | nip width (mm) | Bekk smoothness (sec) | *2 brightness (%) | *3 color density | *4 quality of images | *5 fogging |
| Example 1 | woolen paper | 68° | 30 | 5 | 350 | 78.5 | 0.85 | 3 | 3 |

TABLE 1-continued

| | Supercalendering Treatment | | | | Properties of Heat-Sensitive Record Materials | | | | |
|---|---|---|---|---|---|---|---|---|---|
| | elastic rolls | | nip pressure | | *1 | | | | |
| | material | Shore-D hardness | line-pressure (kg/cm) | nip width (mm) | Bekk smoothness (sec) | *2 brightness (%) | *3 color density | *4 quality of images | *5 fogging |
| Example 2 | woolen paper | 63° | 100 | 9 | 500 | 77.0 | 0.90 | 2 | 2 |
| Example 3 | urethane rubber | 63° | 100 | 9 | 400 | 77.5 | 0.80 | 3 | 2 |
| Example 4 | woolen paper | 63° | 100 | 9 | 550 | 77.0 | 0.90 | 1 | 2 |
| Example 5 | woolen paper | 63° | 100 | 9 | 600 | 76.5 | 0.95 | 1 | 2 |
| Example 6 | urethane rubber | 45° | 250 | 20 | 150 | 79.0 | 0.60 | 3 | 1 |
| Example 7 | urethane rubber | 55° | 200 | 15 | 240 | 78.5 | 0.75 | 3 | 1 |
| Example 8 | woolen paper | 68° | 30 | 5 | 500 | 77.0 | 0.95 | 2 | 1 |
| Example 9 | woolen paper | 68° | 30 | 5 | 450 | 79.0 | 0.85 | 2 | 1 |
| Control 1 | normal cotton | 82° | 70 | 6 | 700 | 62.7 | 1.00 | 2 | 5 |
| Control 2 | urethane rubber | 40° | 250 | 25 | 120 | 79.5 | 0.50 | 4 | 1 |
| Control 3 | normal cotton | 82° | 70 | 6 | 750 | 67.5 | 1.00 | 1 | 4 |

*1 Bekk smoothness was measured by TAPPI standard T 479.
*2 Brightness of the coated surface of heat-sensitive record materials was measured by Hunter multipurpose reflectometer.
*3 Color images were recorded on each record material with use of a practical high speed head-sensitive facsimile (HIFAX-700 manufactured by Hitachi, Ltd., Japan). The color density of the images was measured by Macbeth relflex densitometer RD-100R (manufactured by Macbeth Corporation, USA).
*4 Uniformity of the halftone portion of the images obtained in the above method was examined with the naked eye.
evaluation
1: very good
2: good
3: normal
4: slightly bad
5: very bad
*5 fogging was examined by the naked eye.
evaluation
1: no substantial fogging appreciated.
2: only trace fogging appreciated.
3: dim but not substantial fogging appreciated.
4: substantial fogging appreciated.
5: remarkable fogging appreciated.

What we claim is:

1. A method of the surface treatment of a heat-sensitive record material comprising a base sheet having a heat-sensitive record layer coated thereon, which method comprises passing said record material through a nip between a metal roll and an elastic roll of from 42° to 69° Shore-D hardness defined by ASTM Standard, D-2240, with said coated layer being in contact with said metal roll, at a nip pressure enough to obtain a Bekk smoothness of 150 seconds or above on the surface of said record layer.

2. A method of the surface treatment of a heat-sensitive record material as defined in claim 1, in which said elastic roll has a Shore-D hardness defined by ASTM Standard, D-2240 within the range of 50° to 69°.

3. A method of the surface treatment of a heat-sensitive record material as defined in claim 1, in which said elastic roll has a Shore-D hardness defined by ASTM Standard, D-2240 within the range of 60° to 69°.

4. A method of the surface treatment of a heat-sensitive record material as defined in claim 1, in which the Bekk smoothness of the record layer surface obtained is within the range of 200 to 2000 seconds.

5. A method of the surface treatment of a heat-sensitive record material as defined in claim 1, in which the nip pressure applied between said metal roll and said elastic roll is within the range of 30 to 300 kg/cm.

* * * * *